US005239911A

United States Patent [19]

Ostor

[11] Patent Number: 5,239,911

[45] Date of Patent: Aug. 31, 1993

[54] MULTIPLE-ROUND GRENADE LAUNCHER

[76] Inventor: Pierre A. Ostor, 70 NE. 63rd Way, Fridley, Minn. 55432

[21] Appl. No.: 834,777

[22] Filed: Feb. 13, 1992

[51] Int. Cl.[5] ..... F41A 9/17; F41A 9/64; F41A 9/72

[52] U.S. Cl. ..... 89/33.1; 42/18; 42/50; 42/105

[58] Field of Search ..... 42/2, 9, 18, 22, 50; 89/33.1, 33.17

[56] References Cited

U.S. PATENT DOCUMENTS

| | | | |
|---|---|---|---|
| 1,374,854 | 4/1921 | Johnson | 42/105 |
| 2,358,792 | 9/1944 | Conway | 42/18 |
| 2,499,379 | 3/1950 | Garrett | 42/105 |
| 2,624,241 | 1/1953 | Hill | 89/33.1 |
| 2,773,325 | 12/1956 | Hill | 42/18 |
| 2,882,635 | 4/1959 | Hill | 42/50 |
| 3,435,549 | 4/1969 | Kermode | 42/17 |
| 3,538,635 | 11/1970 | Friend | 42/10 |
| 3,864,862 | 2/1975 | Brunger et al. | 42/105 |
| 4,286,499 | 9/1981 | Gillum | 89/33.1 |
| 4,524,672 | 6/1985 | Balsavage | 89/33.1 |
| 4,825,743 | 5/1989 | Balsavage et al. | 89/33.17 |
| 4,905,394 | 3/1990 | Predazzer | 42/17 |

*Primary Examiner*—David H. Brown
*Attorney, Agent, or Firm*—Leo Gregory

[57] ABSTRACT

A hand operated grenade launcher having a multiple round detachable magazine positioned to overlie the launcher barrel and to cooperatively deposit a cartridge in firing position, the launcher having a gas operated delay blow back action which automatically ejects a fired cartridge and actuates the deposit of a live cartridge in firing position in connection with the magazine.

6 Claims, 10 Drawing Sheets

39
41
52
52a
3B
3A
49
83
26e
50
26f
51b
51c
51

39
41
4
33
33f
80a
91
57b
57
9
4
49
83
57a
26b
26a
26
26f
51c
53
82
80
79
3

39
90
36
35
40
38a
77
38
38b
41
25a
24b
65
24
25
51f
64
43
23
24d
46a
37
23d
24a
44
45
22
34
46
42
21a
21
51d
32
31
23a
21a
33
14c
91-2
51e
44a
19
29
28
67
91-1a
30
47
13b
91-3
51a
18
48
47b
17
14b
27
83
14
91-1
16
15
13
9
7
8
26a
49

MULTIPLE-ROUND GRENADE LAUNCHER

BACKGROUND OF THE INVENTION

1. Field of Invention

This invention relates to a shoulder fired semi-automatic grenade launcher.

2. Brief Description of the Previous Art

This invention relates to a multiple round grenade launcher. The use of grenade projectiles has developed into a widespread application for law enforcement as well as for war time purposes.

The generally used grenade launchers deal with a low velocity single shot type of weapon. The launchers using magazines for multiple shot purposes generally require that the magazines be manually loaded and for the most part the spent cartridge casings must be manually removed from the magazine before reloading.

SUMMARY OF THE INVENTION

This invention embodies improvements in several aspects.

It is a basic object herein to provide a shoulder fired semi-automatic grenade launcher which is capable of delivering maximum firepower with a very reduced overall dimension and weight.

It is another object herein to have a magazine holding a plurality of cartridges, such as ten, being positioned upon the barrel of the launcher and cooperating with a delayed blow back action of the launcher to feed and position cartridges into the firing chamber of the launcher.

It is also an object herein to have the ejection of a spent cartridge automatically accomplished by the firing action of the launcher and the firing chamber being positioned to receive a replacement cartridge from the magazine.

It is also an object herein to provide a grenade launcher in which there is a relatively short action and achieved are two purposes, namely, the ejection of a spent cartridge casing and the feeding and positioning of a replacement cartridge into the firing chamber.

Further, it is an object to provide a semi-automatic launcher in which the first round of ammunition cannot be introduced inside the firing chamber unless the safety lever is placed on its "safe" position.

These and other objects and advantages of the invention will be set forth in the following description made in connection with the accompanying drawings in which like reference characters refer to similar parts throughout the several views.

Figures 1, 2:
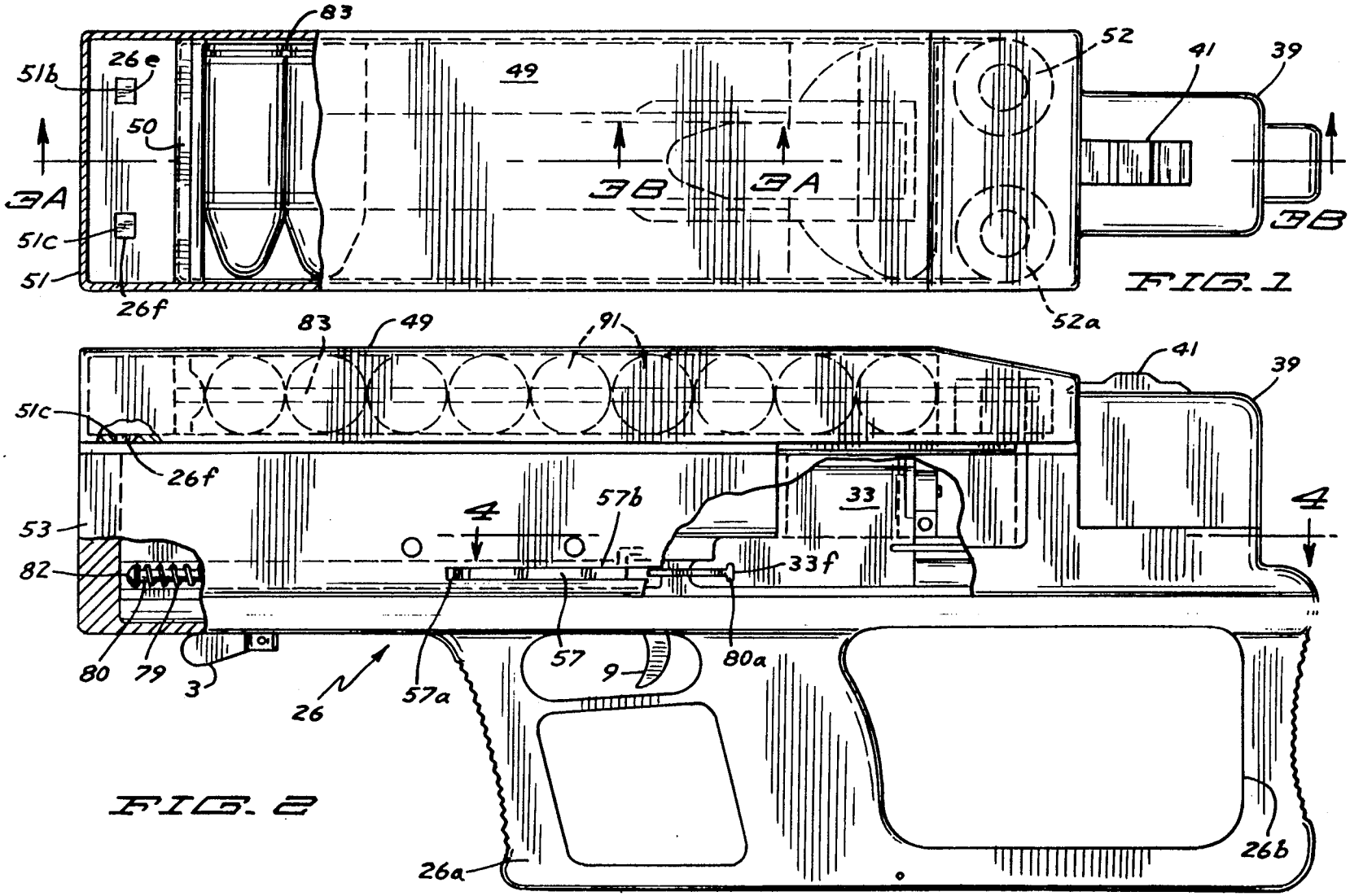
FIG. 1 is a top plan view partially in horizontal section.
FIG. 2 is a view in side elevation with a portion broken away.

It will be noted that in several of the views parts are shown in dotted line.

DESCRIPTION OF A PREFERRED EMBODIMENT

With reference to the drawings, the invention herein comprising a multiple round shoulder fired semi-automatic grenade launcher is indicated by the reference numeral 10.

FIGS. 1 and 2 respectively show a top plan view and a view in vertical section with some parts being shown in dotted line and in which the basic parts comprise a magazine 51, a barrel 53, a frame 1 and an underlying body 26 which includes a pistol grip **26*a*, a trigger 9, a cocking lever 57, a safety lever 3 and a shoulder stock 26*b***.

Significant here is the overall length of a full scale model of the grenade launcher herein which is on the order of nineteen inches. This overall relatively short compact length should be borne in mind as the description continues.

Supported upon the body 26 and overlying the barrel 53 is the magazine 51 which as here shown is capable of receiving and holding ten rounds of grenades 91. The individual grenades are indicated as 91-1, 91-2 and etc.

Said magazine is here shown to be parallelepiped in form and preferably is molded of a suitable plastic material. The magazine is loaded manually by inserting each round through the rear bottom loading-unloading gate **51*a***.

Figure 21:
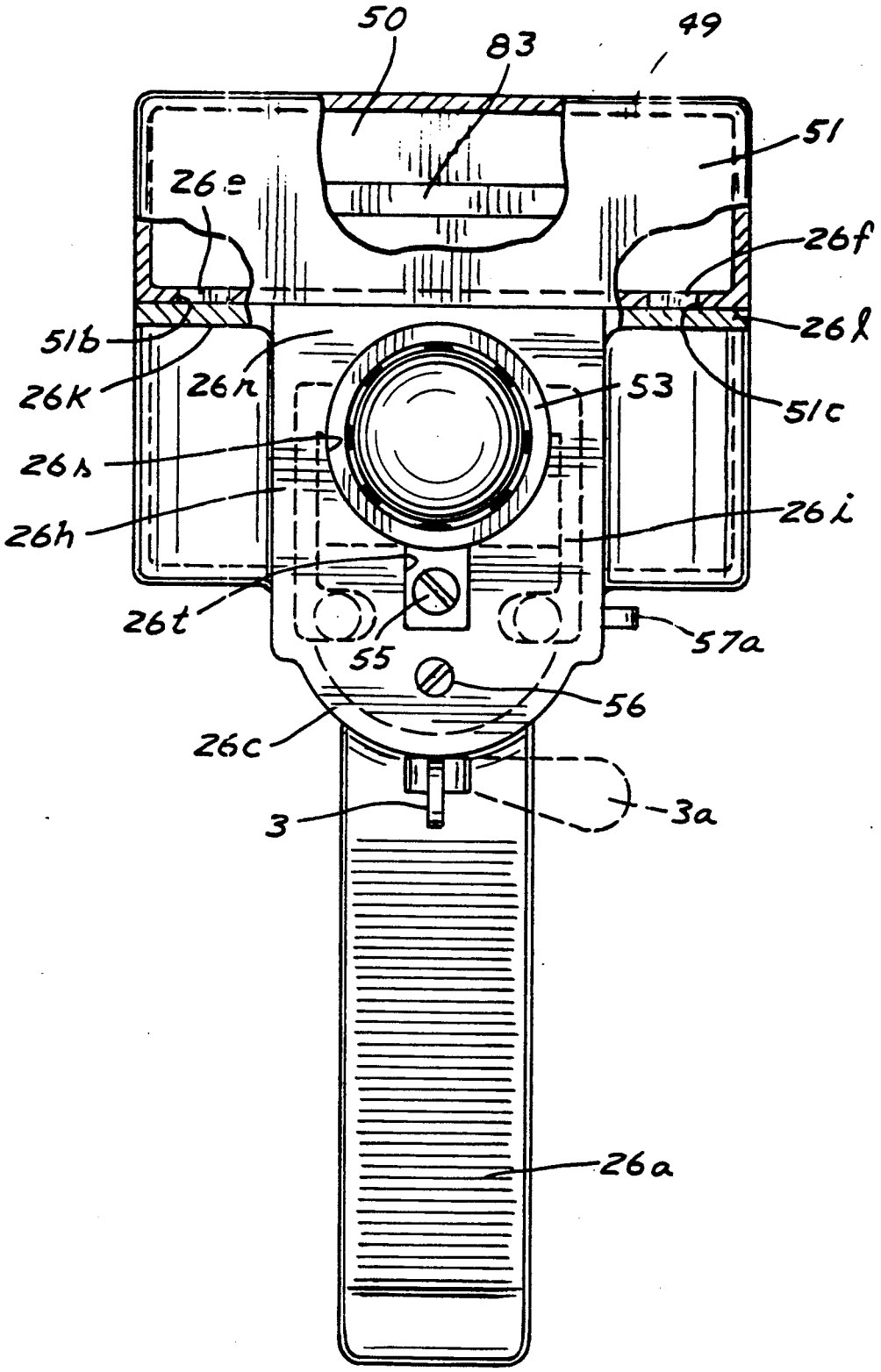
FIG. 21 is a view in front elevation with some portions broken away.

In loaded condition, the magazine is removably positioned upon said body 26 and overlying the barrel 53. Two openings **51*b* and 51*c* are present in the front bottom of said magazine and these are disposed over two protrusions 26*e* and 26*f* of the leading upper edge portion of said body 26 as shown in FIG. 21. Though not shown, said protrusions have inwardly angled faces whereby a releasable locking engagement is had. The rear end portion or compartment 51*d* of said magazine is pushed downwardly against the angled face of the magazine latch 41 to engage an adjacent notch 51*f* of said magazine. Said latch 41 yields to the pressure of said magazine by bearing against its rearward coil spring 40**.

As indicated in FIG. 2, said rounds of grenades are positioned cross-wise of said magazine and putting said rounds under a rearward pressure is an upstanding slide member 50. At the rearward end of said magazine is a compartment 51*d* within which are suitably anchored on transversely spaced spools 52 and 52*a* a pair of transversely spaced coil strap springs 83 and 83*a*. The forward free end portions of said springs are suitably secured to said slide member 50 whereby said springs are under constant tension causing said slide member to constantly bear against the grenade rounds causing them to move rearwardly with the firing of each round. The movement of a round through the gate 51*a* preceded by the ejection of the casing of a fired round will be hereinafter described.

Referring now to the body 26, said body (FIGS. 4,5,8 and 21) has an upper portion elongated and generally rectangular in plan having a bottom wall 26*c* having a radius and having upstanding transversely spaced side walls 26*h* and 26*i* which have upper right angled shoulders 26*k* and 26*l* which underlie and support said magazine. Said body has a channel 26*p* the full length thereof as defined by said bottom and side walls as shown in FIG. 5. Through the front end wall 26*r* is a circular end opening 26*s* having a depending slot portion 26*t*. Inset from the top of the rear wall 26*u* thereof is a slot 26*v*.

Figure 4:
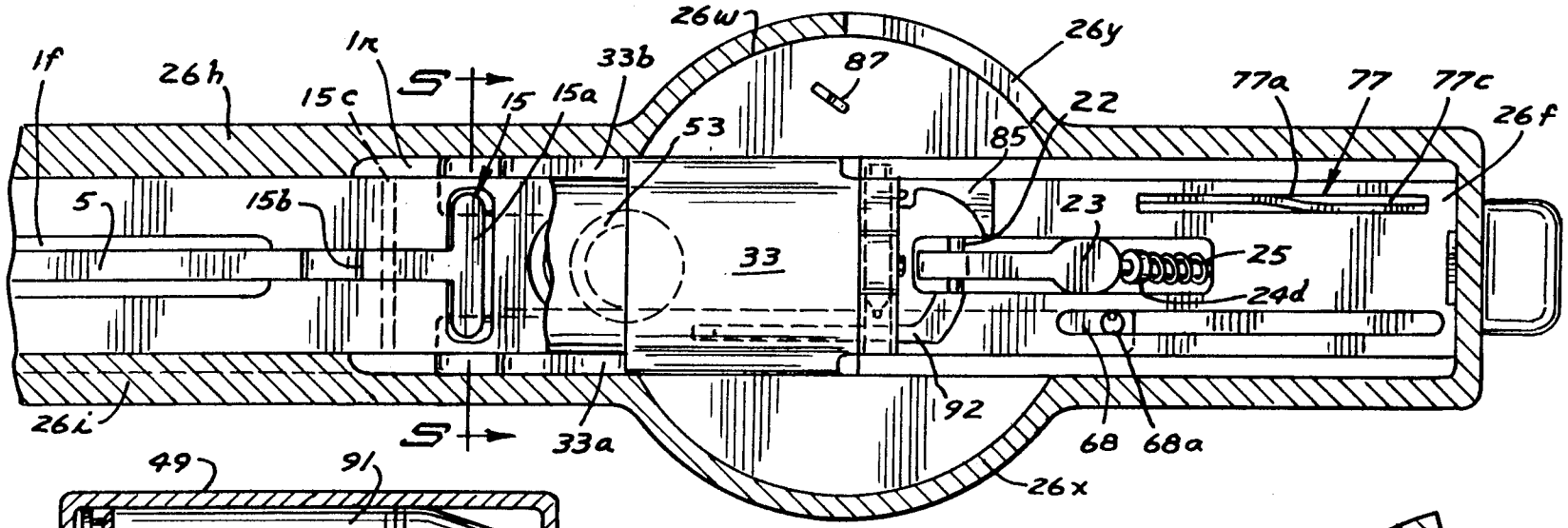
FIG. 4 is a view in horizontal section taken on line 4—4 of FIG. 2 as indicated.
Figure 6:
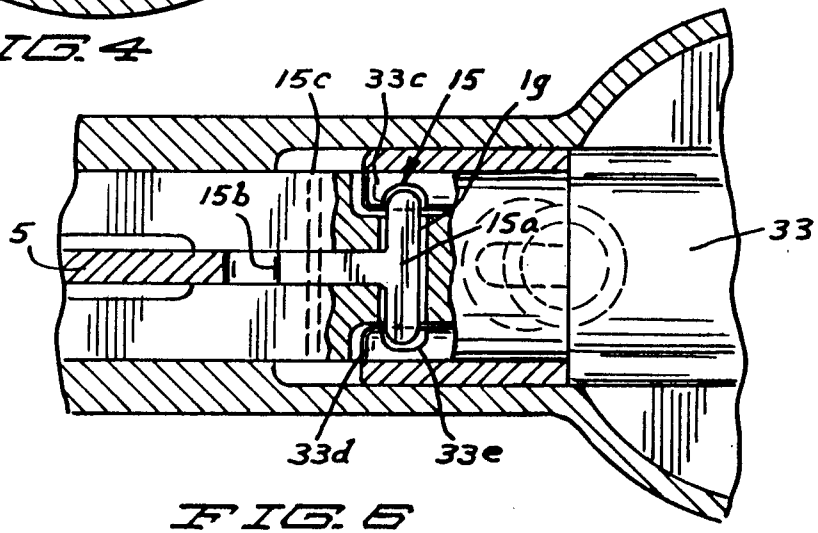
FIG. 6 is a broken view in horizontal section.
Figure 5:
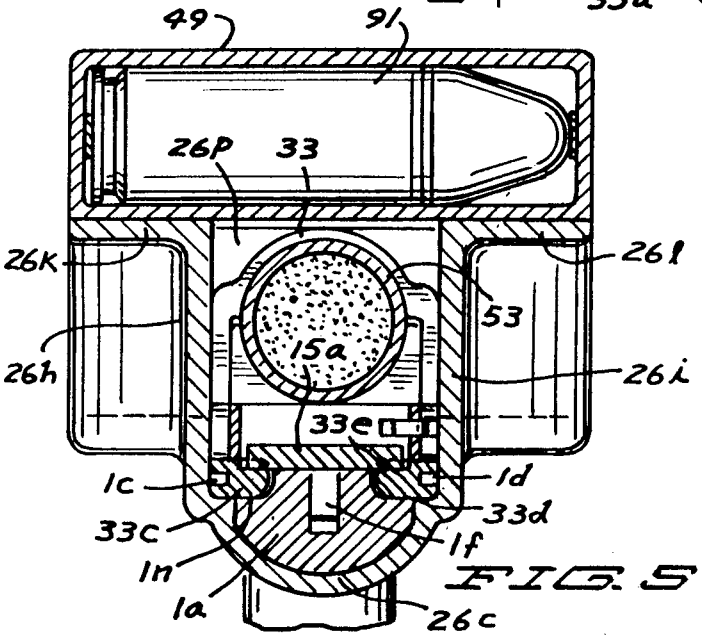
FIG. 5 is a view in horizontal section taken on line 5—5 of FIG. 4 as indicated.

As indicated in FIGS. 2 and 4, said cocking member 57 is carried in a channel 57*b* in said body 26 and has an outward extending operating handle 57*a*. Said cocking member is adapted to be a release member as will be described in the operation hereof.

Reference will now be had to the frame member 1 which is also shown in cross section in FIG. 5 having a bottom wall portion 1*a* having a radius corresponding to that of said bottom wall 26*c* and having full length upper rectangular shoulder members 1*c* and 1*d*. Said frame is disposed vertically into said channel 26*p* of said body member and is supported by the bottom and side walls thereof. Between said shoulders at the forward half of said frame is a rectangular slot 1*f*. Adjacent the rearward end of said slot and extending inwardly from the bottom of said frame is said trigger 9 secured by a pin 9*a* extending transversely therethrough and through a corresponding hole through said frame. Through the upper rear portion of said trigger extends a pivot pin 7 which provides an eccentric pivotal connection with a trigger connection bar 14. Carried on said frame member and engaging the rear side of said trigger and being pivoted thereabove is a butterfly trigger spring 8 which is adapted to return the trigger to firing position.

At the forward end of said slot 1*f* is a tee slot 1*g*. Disposed in said tee slot is a lock member 15 having a tee shaped head portion 15*a* and an angled depending leg portion 15*b*. Said lock member is pivotally secured by a pin 15*c* extending through an aperture in said frame at an angled portion of said lock member as shown. The aperture in the frame is shown in dotted line.

Figure 3A:
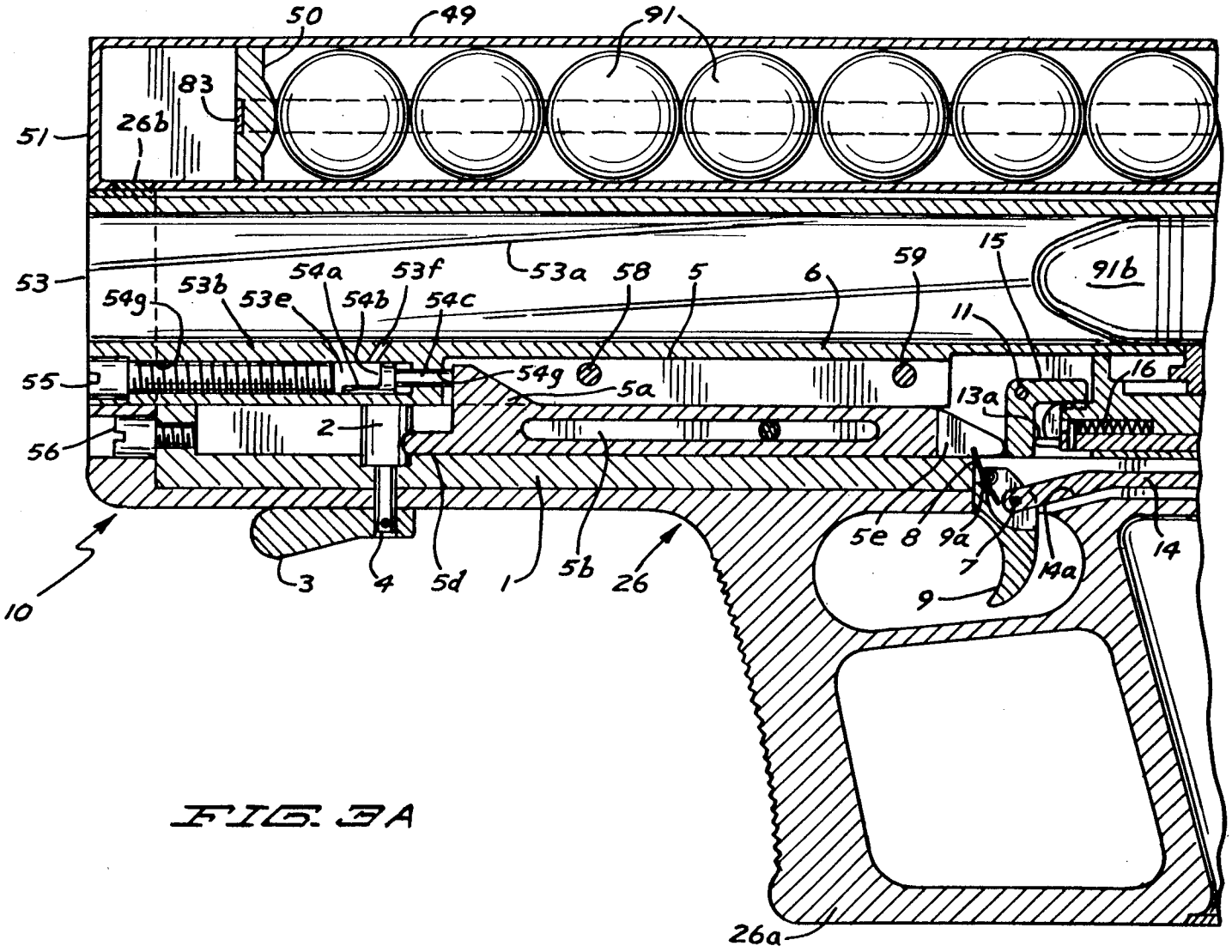
FIGS. 3A and 3B are a composite view in vertical section taken respectively on lines 3A—3A and 3B—3B of FIG. 1 as indicated.
Figure 3B:
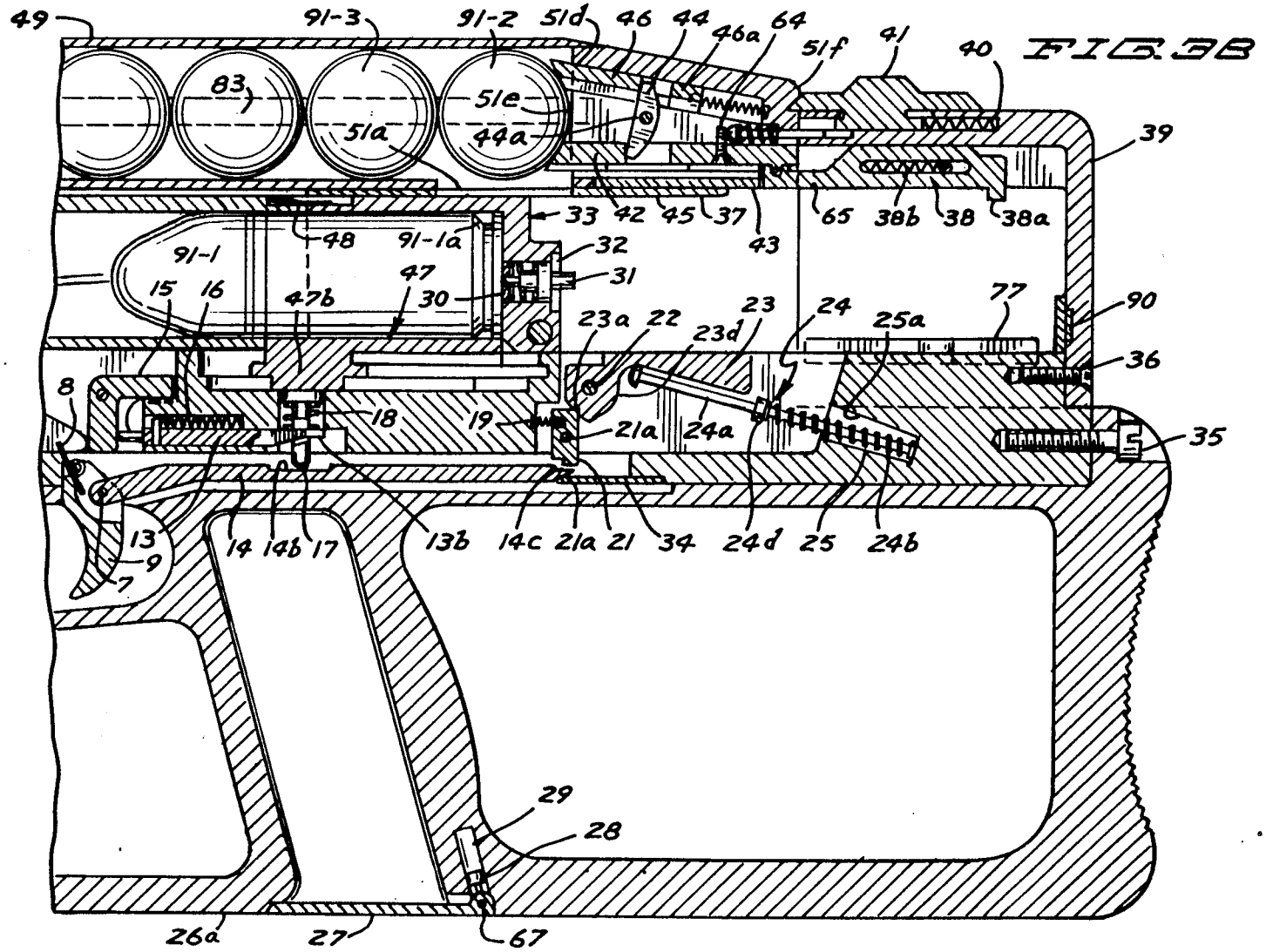
Figure 7:
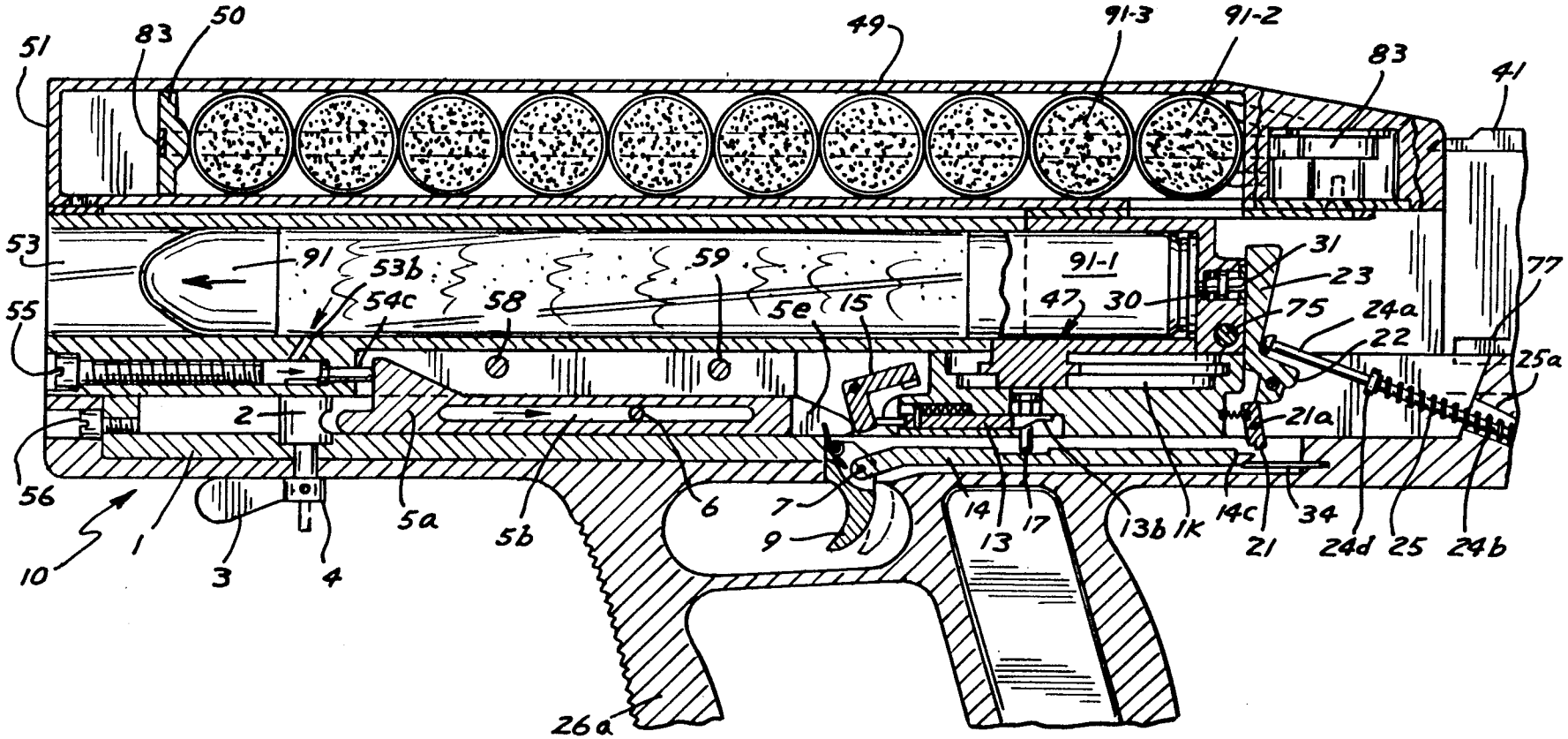
FIG. 7 is a view in vertical section.

With reference to FIGS. 3*b* and 7, a safety member 13 is shown which extends rearwardly of the depending leg of said lock member, the safety member having a reduced forward projection 13*a* having engagement therewith extending into a small recess thereof as shown. The safety member is rectangular in plan having rearwardly thereof a forked tail end portion 13*b* having a reduced vertical dimension. Disposed over said split tail portion and extending downwardly therethrough is a safety plunger 17 on the order of a large headed bolt having its stem portion extend downwardly and having a coiled spring 18 disposed thereon between said tail portion and the head of said safety plunger.

Pivoted to said trigger by a pivot pin 7 is said connecting bar 14 having a forwardly downwardly angled head portion 14*a* and extending rearwardly as illustrated, said bar has a notch 14*b* into which extends said safety plunger 17. At the rear end portion of said bar 14 is formed a small ledge 14*c*. Engaging said ledge with its reduced bottom portion 21*a* and extending upwardly therefrom is a sear 21 pivoted by a transverse pin 20 secured to the frame. A coil spring 19 appropriately secured to said sear extends outwardly to bear against an adjacent portion of said frame urging said sear rearwardly to engage a recess or notch 23*a* on the head portion of the hammer 23, the head portion having therethrough a transverse pin 22 suitably secured to the frame. Said hammer extends rearwardly having an angled underlying recessed portion 23*d* into which extends the forward portion 24*a* of a bolt like hammer spring guide 24 seated in an accommodating recess 25*a* of the frame and a coil spring 25 is disposed about the end portion 24*b* of said guide is said recess urging the same forwardly, said spring being retained by a collar 24*d*.

Disposed in said slot 1*f* is a safety and actuating lock bar 5 which at its forward end portion has a pair of transversely spaced upwardly angled ears 5*a* and extending through and along a major portion of the body thereof is a transverse slot 5*b*. Extending through said slot substantially at the midpoint thereof is a frame secured pin 6.

Engaging the forward projecting end 5*d* of said bar 5 is a safety cam 2 which is secured to a vertical pin 4 and secured to said pin below said frame for rotational movement of said pin and said cam is said safety lever 3 (FIG. 3*a*).

The tapered rearward end 5*e* of said bar 5 extends just over the upper portion of the trigger 9 and is in position with a rearward motion to engage and actuate the depending leg portion of the lock member 15.

Figure 17:
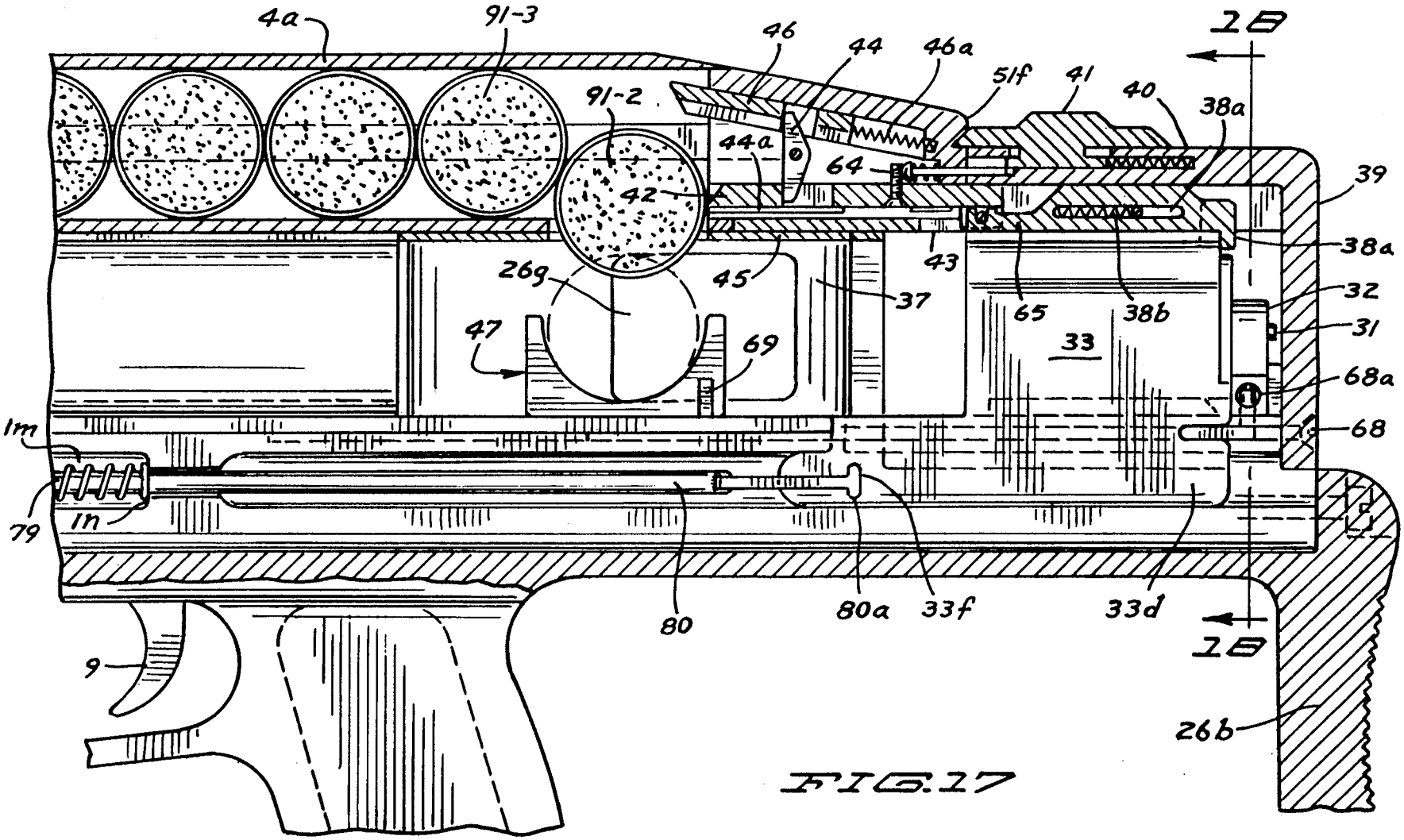
FIG. 17 is a broken view in vertical longitudinal section.

Referring now to FIGS. 5 and 17, underlying the forward portions of said shoulders 1*c* and 1*d* are a pair of elongated open sided channels 1*m* and 1*n* into which are disposed main spring rod guides as represented by spring retained guide 80 having tee formed rearward end portions 80*a*. Disposed over said guides are main springs represented by 79 which are secured in position by enlarged head retaining screws 82 threaded into the forward ends of said guides (FIG. 2). The inner ends of said channels as in 1*na* form shoulders to retain said springs and compress the same as the guides are moved rearwardly.

Now, reference will be had to the rearward substantially half portion of the frame member. The shoulders 1*c* and 1*d* merge rearwardly of the slot 1*g* to form a top frame wall 1*p*. Formed in said wall and extending therethrough rearwardly of said slot 1*f* is an elongated slot opening 1*h* having an enlarged rounded end portion 1*ha* at its forward end and a rounded end portion 1*hb* at its other end and forming a track 1*gc* on its bottom wall by having an elongated recess therein.

Disposed to slide upon said track within said slot is a pivoting block 47 which has a semi-cylindrical open top 47*a* to receive a grenade and support and place the same in a firing position and having a forwardly projecting curved portion underlying which is a stationary toothed cog member 47b having a plurality of teeth 47c at one side thereof (see FIGS. 9–16 for detail).

Figure 8:
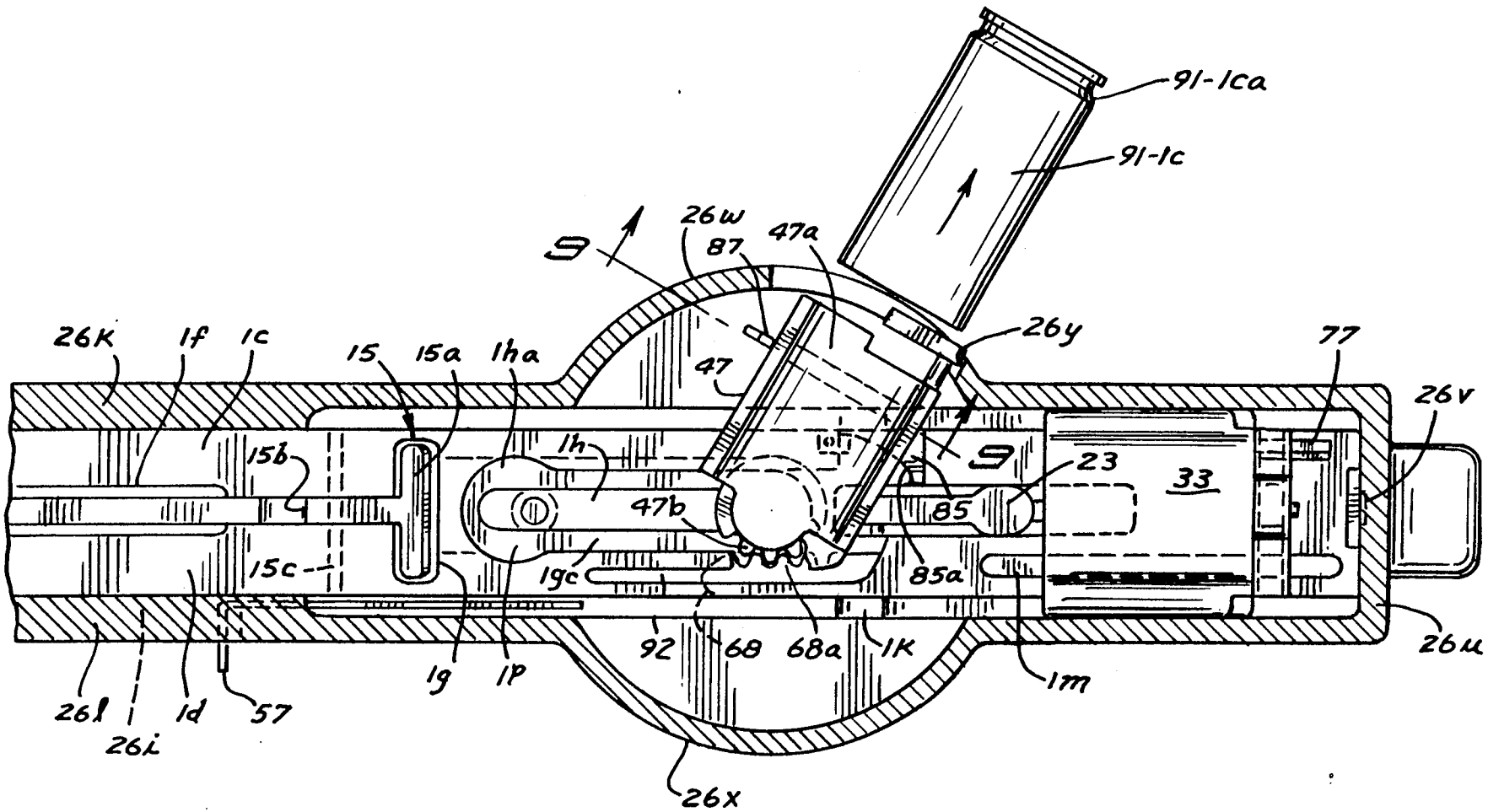
FIG. 8 is a broken view in horizontal section.
Figure 9:
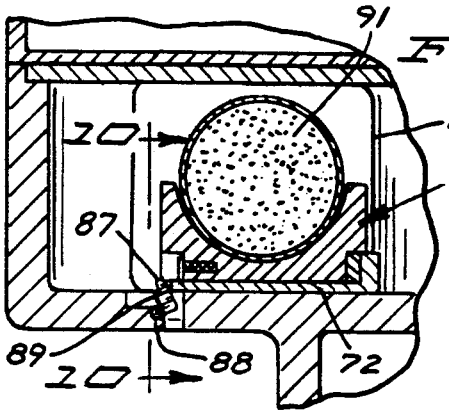
FIG. 9 is a broken view in horizontal section taken on line 9—9 of FIG. 8 as indicated.
Figure 10:
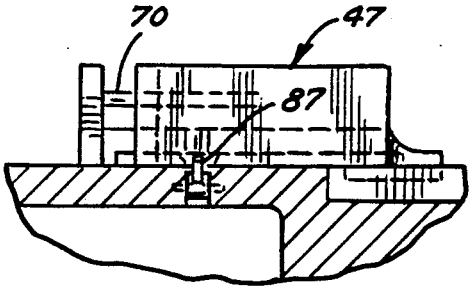
FIG. 10 is a view in vertical section taken on line 10—10 of FIG. 9 as indicated.
Figure 11:
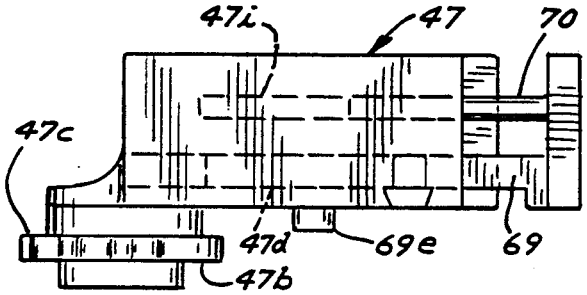
FIG. 11 is an isolated view of a detail of structure in side elevation.
Figure 18:
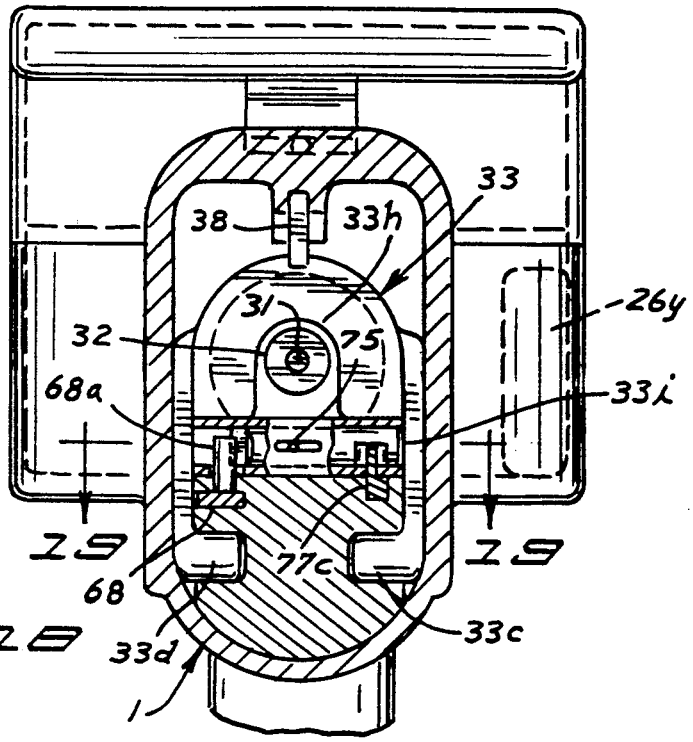
FIG. 18 is a view in vertical section taken on line 18—18 of FIG. 17 as indicated.
Figure 19:
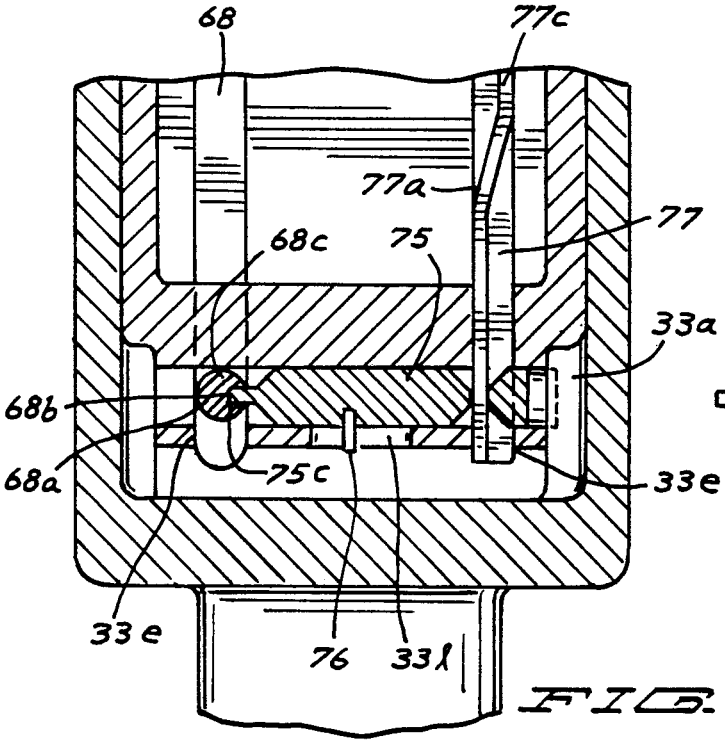
FIG. 19 is a view in horizontal section taken on line 19—19 of FIG. 18 as indicated.
Figure 20:
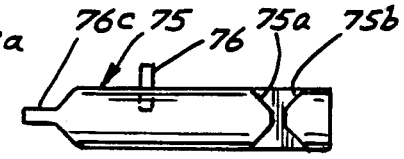
FIG. 20 is a view in elevation showing a detail of structure.

Formed in the rearward portion of the shoulder 1d and extending transversely therethrough is an open sided slot 1k and within the same is positioned a rack member 68 which is elongated and rectangular in cross section having at its forward end portion a plurality of cog teeth 68a which engage the teeth 47c of said cog and which at its rearward end has an upstanding protrusion 68b and having in said protrusion a vertical notch 68c, said protrusion extending upwardly through an elongated slot 1m as indicated (see FIGS. 8,18 and 19).

Figure 12:
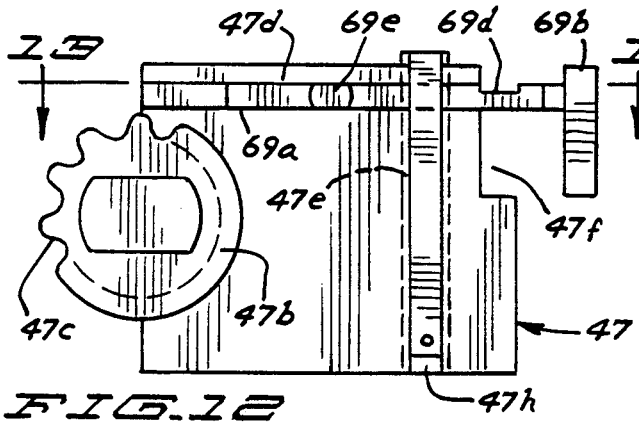
FIG. 12 is a view related to FIG. 11 taken in bottom plan.
Figure 14:
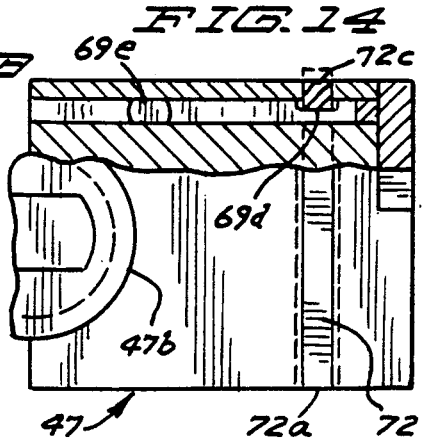
FIG. 14 is a view similar to that of FIG. 12 showing alternate positions of details of structure.
Figure 13:
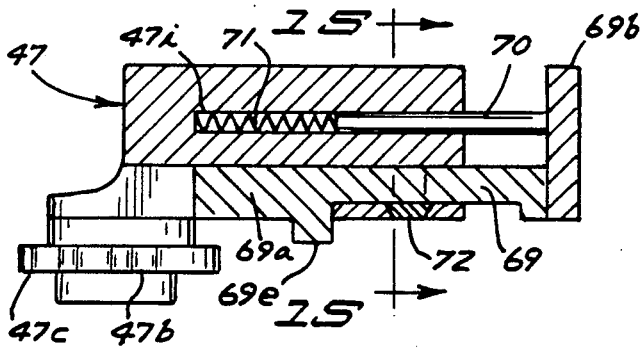
FIG. 13 is a view in vertical section taken on line 13—13 of FIG. 12 as indicated.
Figure 15:
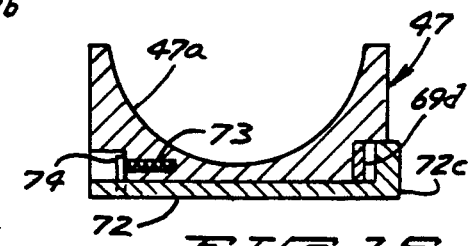
FIG. 15 is a view in vertical section taken on line 15—15 of FIG. 13 as indicated.
Figure 16:
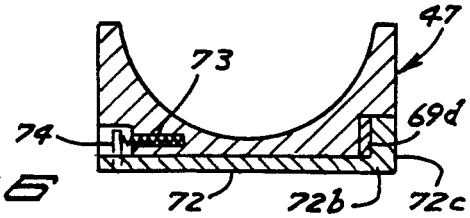
FIG. 16 is a view similar to that of FIG. 15 showing alternate positions of details of structure.

With reference to the pivoting block 47 as in FIGS. 8 and particularly 9–16, a bottom perspective view is shown wherein there is an open bottom slot 47d along the side adjacent said cog and a cross-wise slot 47e adjacent the rear end thereof remote from said cog. There is a recess 47f as shown in FIG. 12. Said slots 47d and 47e are referred to as forming tracks.

Above the rear end of said track 47d, there is an aperture or hole 47i (FIG. 13) extending into said pivoting block and disposed therein is a coil spring 71 having bearing inwardly thereagainst a plunger 70. Adapted to ride in said track 47d is an ejector 69 having a forward body portion 69a rectangular in cross section and having an upwardly extending ledge 69b which extends above said track and engages the outward end of said plunger moving the same inwardly of said hole against the pressure of said spring 71. The body portion 69c of said ejector extending rearwardly has the height of said forward portion and said ledge and extending transversely thereof thereunder is a slot 69d. A small projection 69e extending down from said body portion 69 extends into and is guided by an elongated slot 92 in the body of said frame as will be described. The rearward body portion 69 of the ejector when the ejector is bearing against said plunger is fully within said recess 47d.

Disposed into said track 47e is an ejector sear 72. Said ejector sear is a flat plate like elongated member having a small thickness and a narrow width having an aperture 72a adjacent its rear end and having a forward end portion 72b of reduced width having an upwardly projecting end portion 72c. Said ejector sear is disposed into said track 47e and said projection 72c thereof seated in an elongated recessed portion 27h of said track as shown bearing inwardly against a coil spring 73 in said recessed slot, said spring being suitably secured by a pin 74.

Mounted onto said frame for a coordinated operating relationship with said pivoting block is a member 33 comprising a bolt. As will be described, said bolt and said pivoting block form a portion of the firing chamber.

Said bolt is an open bottom semi-cylindrical member having forwardly projecting side wall portions 33a and 33b of reduced height. Said member has lengthwise inwardly extending runners 33c and 33d which slide in open sided tracks formed at each side of said body 26 with the representative track 1r being indicated in FIG. 4.

Formed at the front end outer side portion of said runner 33d is a notch 33f with a forward extending slot as shown. This represents a like notch in the runner 33c. At the inner front end portions of said side wall portions are opposed notches 33e.

Said bolt 33 has a rearward projection 33h having disposed therein a spring loaded firing pin 31 secured in position by a threaded bushing member 32.

Extending transversely into said rearward projection is a bore 33i and adapted to be disposed therein is a rack lock member 75 which has a projection 75c which seats in the notch 68c of the rack member 68. Said rack lock member is secured in an endwise movable position by a pin 76 extending through an axial transverse slot 76b and a corresponding transverse slot 33l in the rear wall of said bolt and is engaged on an upwardly projecting linear extending cam member 77. Said cam member 77 as shown is mounted onto said frame being substantially rectangular in plan standing on edge and having a track 77c thereon which has a middle angled portion 77a as in FIGS. 4 and 19 for a corresponding lateral shifting movement from one side to the other. Said member 77 has the slotted rack lock member 75 disposed thereover whereby in moving longitudinally thereof it shifts laterally on said cam member 77 moving the bolt 33 with it and by engagement of the cog teeth of said pivoting block cause it to pivot.

As will be further described, said bolt 33 extends over and cooperatively moves with said pivoting block 47.

In the far side of said frame as indicated in FIG. 8, is a top surface recess 85c into which is secured as by rivets an ejector cam member 85 having a curved cam surface 85a, the function of which will be described hereinafter in the operation of the structure.

With the bolt member 33 positioned on the frame 1, the T-shaped ends of the guides 80 and 80a are disposed respectively into the notches 33f thereby compressing said main springs 79 and 79a and thus having said bolt member 33 under constant tension.

The frame member having been described into an assembled condition, the same is placed in operating position by being vertically downwardly disposed into the channel 26p of the body member 26 and is secured therein by the two end wall body screws 55 and 56 through the end walls of said body member and into the adjacent end walls of said frame member. Appropriate apertures are provided for said screws.

The barrel 53 now will be positioned within said body member on top of said frame member. The front wall 26k of said body 26 having said keyhole opening 26l and depending slot 26m therein conform to the cross section configuration of said barrel and said barrel is slid into the channel 26p of said flange or rib 53b for a major portion of its length which slides into the slot 1f and there are a pair of longitudinally spaced transverse holes therethrough in alignment with corresponding apertures 26q in said body into which pins 58 and 59 are secured.

There is a transverse slot 53e through the forward portion of said flange 53b (FIG. 3A). Adjacent said slot 53e axially of said flange a hole 54g is provided with a reduced rearward extension for limited axial movement of a piston 54 which underlies a vent 53f in said barrel as shown in FIG. 3a.

Said piston has a forward extending flat plate portion 54a having an upstanding ledge portion 54b terminating in a plunger portion 54c.

Said flange is drilled inwardly from its front end to provide the hole 54g extending to the slot 53e and a plug 55 in the form of a bolt is threaded therein to close the forward portion of said hole.

Laterally of the top walls 26h and 26i are oppositely curved body extensions 26w and 26x curved to define or form the separated portions of a circle and particularly the extension 26w forms an ejector housing, the outer wall portion 26w having an opening 26y therein to accommodate an ejector release 87 which has an activating butterfly spring 89 (FIG. 9) to eject a fired or spent casing therethrough as will be described. Recessed into the top of said body portions 26*w* and 26*x* is a guide plate member 37 having an opening therein to pass through a grenade.

Next, to have the whole device in operating position, the magazine will be placed in operating position but first the rear compartment 51*d* of the magazine will be described.

Said compartment has a front wall 51*e* and a rear wall 51*f* (FIGS. 3B and 17). The front wall is adjacent the loading-unloading gate 51*a*. Centrally of said compartment extending rearwardly is a vertical opening 51*g* having a widened slot at the top thereof and a like slot spaced upwardly from the bottom thereof but not here shown. A magazine pusher 46 having a rectangular opening 46*a* therein is slid into said upper slot. A magazine retainer 42 substantially rectangular in plan having a rectangular slot 42*a* is disposed into said lower slot.

On the opposed walls of said opening 51*g* are corresponding vertical guides as narrow channels not here shown and a lever 44 rectangular in plan with rounded ends has a pin 44*a* therethrough and which extends into and rides into said opposed channels not shown. The function of these parts will be described.

Underlying said compartment is a bottom removable cover plate 45 and overlying said magazine is a removable top cover 49. The positioning of said magazine has been herein before described.

Mounted onto said body 26 at the rear thereof seated above said shoulder stock 26*b* and abutting said magazine and secured thereto by a screw 36 is a dust cover 39. Said dust cover has a rounded top and spaced side walls as shown in FIG. 3*b*.

Said dust cover carries at its front top edge portion a magazine latch member 41 previously mentioned herein. Carried at the inside bottom of the rear wall of said dust cover is a buffer member 90 which is circular with a flat face.

A feeding actuator 38 is mounted at the front end inside wall of said dust cover, as shown in FIG. 3*b*, wherein there is shown a horizontal slot 38*a* having a coil spring 38*b* therein. The function of the actuator will be described with the operation hereinafter.

OPERATION

With the description of the structure and the assembly of the grenade launcher having been given, the operation thereof will now be described.

To load the first round, the safety lever 3 is pivoted to a safe position at 90° from the center line or axis of the barrel 53, pivoting it either clockwise or counterclockwise rotating its safety cam 2 as shown at 3*a* in FIG. 21.

When the safety lever 3 is moved to said safe position, the safety and lock actuating bar 5 is moved rearwardly under the pressure of said safety cam 2 and forces the lock member 15 to rotate counterclockwise unlocking the bolt 33.

Next, the cocking lever 57 (FIG. 2) is moved rearwardly to the point of contacting the front right face of the bolt 33 (FIG. 2). The bolt moves rearwardly, the two main spring guides 80 and 80*a* connected to the bolt notches 33*f* (FIG. 17) compress their respective main springs 79 and 79*a*. The bolt contacts the protrusion 68*a* of the rack 68. The bolt continues to move rearwardly and the rack follows with the pivoting block 47. When the pivoting block reaches the end of its track 1*h*, it is rotated counterclockwise to a 90° angle by action of the rack 68 (at a 60° angle an empty grenade case would be ejected were this a second or subsequent round). Said bolt forces the hammer 23 to rotate clockwise compressing its spring 25. The hammer is caught by the sear 21. The bolt still moving rearwardly forces the feeding actuator 38 to move compressing its spring 38*b*. Said actuator being connected to the retainer 42 of the magazine 51 forces it rearwardly. When the retainer is fully retracted within the magazine, the pusher 46 forces the first round downward through gate 51*a* to seat in the pivoting block under the pressure of the magazine spring 52.

Upon release of the cocking lever, the two main magazine springs 83 and 83*a* move the bolt 33 forwardly, and the pivoting block 47 connected to the bolt by the rack 68 rotates clockwise. When the pivoting block carrying the first round 91 of the grenades is aligned with the barrel 53, it moves forwardly followed by the bolt 33. The pivoting block engages contact with the adjacent end of the barrel. The bolt moving forwardly overlies the pivoting block. Next, the safety lever 3 is pivoted to a firing position which is the alignment of the safety lever with the axis of the barrel and the first round is positioned to be fired.

In firing the weapon, when the operator pulls the trigger 9 causing it to pivot counterclockwise, the trigger's connecting bar 14 is moved rearwardly and its rear end 14*a* comes into contact with the lower part 21*a* of a sear 21 actuating the sear to pivot counterclockwise compressing its spring 19, at the same time, the hammer 23 is released and the trigger connecting bar is released from said sear and the sear is pivoted clockwise until it contacts the hammer 23. The hammer pivots counterclockwise under the pressure of its spring 25. The upper part of the hammer engages with the firing pin 31 driving it forwardly compressing its spring 30. The firing pin impacts the primer (not shown) of the round in firing position.

The first round or grenade 91-1 upon impact of the firing pin and grenade primer is caused to travel through the rifled bore of the barrel 53. The gas vent 53*b* present in the forward bottom portion of the barrel receives a quantity of the gas passing through the barrel. Only a small quantity of gas is released through this vent but the pressure of this gas resulting from the firing of the round is sufficient to force the piston 54 to move rearwardly as it continues to force the grenade projectile 91-1 forwardly and discharge it from the barrel.

Said piston 54 causes the safety lock actuator 5 to move rearwardly forcing the lock 15 to pivot engaging the safety member 13 moving it rearwardly to compress its spring 16 forcing the safety plunger 17 to move downwardly compressing its spring 18. The safety plunger pushes the trigger connecting bar 14 downwardly avoiding contact with the sear 21 when the bolt 33 is unlocked.

The gas pressure inside the bore from the fired round forces the empty case from the fired round to move rearwardly. The empty case transmits its movement to the bolt 33 and also the pivoting block 47. The ejector 69 mounted upon the pivoting block 47 is engaged inside the rim groove 91-1*a* of the grenade case 91-1.

The rack 58 follows the pivoting block 47 being engaged on the gear teeth 47*a* thereof. As the bolt and pivoting block move rearwardly, two main spring guides 80 and 80*a* connected to said bolt compress the main springs 79 and 79*a*.

The hammer 23 is caused to rotate clockwise compressing its spring 25. The firing pin 31 moves rearwardly responsive to the pressure of its spring 30.

The pivoting block 47 stops at the end of its track 1*hb* with the rack member 68 and the bolt 33 continues its rearward movement under its momentum compressing the main springs 79 and 79*a*. The bolt comes into contact with the protrusion 68*a* at the rear end of the rack 68 (FIGS. 8 and 9–16). This protrusion engages the slot 33*l* in the bolt 33. As said bolt continues to move rearwardly, the rack lock 75 is engaged on the rack lock cam 77. The slot 75*b* of said rack lock comes into contact with the angled portion 77*a* of the rack lock cam causing it to move to the left as seen in FIG. 19. The end 75*a* of said rack lock engages the notch 68*b* of the rack 68. The bolt and the rack moving rearwardly force the pivoting block 47 to rotate counterclockwise.

When the pivoting block reaches a 60° angle, the ejector sear 72 hitting a spring loaded release 87 mounted on the body releases the ejector 69. The ejector moves backward under its spring pressure discharging the empty case out of the weapon through its ejection port 26*y*. The pivoting block 47 continues to rotate counterclockwise. Between a 60° and a 90° angle of the pivoting block, the lower projection 69*e* of the ejector in contact with the ejector cam (FIG. 8) forces the ejector cam to move forward inside of the pivoting block track. At 90° the ejector is caught by the ejector sear 72. The bolt 33 prior to engaging with the buffer 90 catches the feeding actuator 38 mounted inside the dust cover 39.

The feeding actuator moves backwardly compressing its spring 52 and forces the magazine retainer 42 to move rearwardly compressing its spring 43.

The magazine retainer 42 connected to the magazine pusher 46 by a lever 44 forces the magazine pusher to move forward. The magazine pusher 46 pushes the second grenade round 91-2 downwardly.

When the center line of the second round is lower than the center line of the third round 91-3, the pressure of the clock springs of the magazine will finish to push the second round downwardly. The second round falls into said pivoting block 47.

The bolt 33 under pressure of the two main springs 79 and 79*a* moves forwardly. The rack 68 engaged in the bolt follows the bolt. The feeding actuator moves forward. The magazine retainer 42 moves forwardly holding the third round. The magazine pusher moves backwardly.

The rack 58 engaged on the teeth of the pivoting block 47 forces it to rotate clockwise. When the pivoting block 47 is aligned with the barrel, the pivoting block and the bolt move forwardly together, the hammer 23 rotating counterclockwise catches on the sear 21.

The pivoting block enters into contact with the barrel and thus extends the fore part of the grenade 91-2 and part of the case 91-2 of the second round into the inside of the chamber of the barrel. The slot 75*b* of the rack lock comes into contact with the outer cam face 77*b* forcing it to move to the right. The left end 75*a* of the rack lock disengages out of the notch 68*b* of the rack. The bolt continues in a forward movement overlapping the pivoting block.

The lock rotates clockwise and engages inside the notches 33*e* of the bolt. The safety 3 moves forward. The safety plunger 17 moves upward. The safety and lock actuating bar move forwardly. The operator releases the trigger. The trigger connecting bar 14 moves forwardly and engages on the sear 21 under pressure of its spring 24.

The weapon is ready to fire its second round.

It will of course be understood that various changes may be made in form, details, arrangement and proportions of the parts without departing from the scope of the invention herein which, generally stated, consists in an apparatus capable of carrying out the objects above set forth, in the parts and combination of parts disclosed and defined in the appended claims.

What is claimed is:

1. A semi-automatic multi-round grenade launcher, having in combination a frame member, an elongated slot forming a track in said frame, a grenade receiving pivot block disposed on said track, a bolt member movable along said frame, a rack member connecting said pivot block and said bolt, a pair of elongated springs attached to said bolt under tension, a grenade casing ejector port adjacent said slot, said rack member causing said pivot block to rotate adjacent the end of said slot, a magazine disposed above said frame axially of said barrel, means in connection with said magazine adapted to unload a grenade therefrom, said magazine having a grenade unloading gate vertically aligned with said pivot block when said pivot block is angled at 90° thereto, said springs retracting said bolt and the same engaging said pivot block causing it to retract 90°, whereby said bolt engages and overlies a portion of said pivot block and moves forwardly to engage said barrel forming a firing chamber therewith.

2. A hand operated multi-round grenade launcher, having in combination a body having a frame therein, a barrel carried in said frame, a magazine overlying said body above said barrel, said magazine being adapted to carry a plurality of grenades therein cross-wise thereof, a loading-unloading gate in said magazine, an elongated slot in said frame forming a track, a pivoting block movable on said track having an upper carriage adapted to receive a grenade, a bolt movable on said frame aligned with said pivoting block, said pivoting block having a depending stationary cog having a plurality of teeth, a rack member slidable in said frame having a toothed portion engaging said teeth of said cog and having an extended handle engaged with said bolt, a pair of coil spring members secured to said frame and extending to and being secured under tension to said bolt urging the same in the direction of said pivoting block, said rack causing said pivoting block to pivot to receive a grenade and to become aligned with said barrel upon receiving said grenade, and said bolt responsive to urging by said springs moving forward on said frame to overlie said pivoting block and the grenade carried thereby and engaging said barrel to form a firing chamber therewith.

3. The structure of claim 2, wherein said bolt carries a firing pin to impact a grenade primer.

4. The structure of claim 3, wherein said bolt and pivoting block in forming a firing chamber with said barrel, extend the projectile portion of a grenade and the forward portion of the casing thereof into said barrel.

5. The structure of claim 3, wherein said bolt in moving forwardly actuates means to release a grenade from said magazine and deposit the same onto said pivoting block.

6. A hand operated multi-round grenade launcher, having in combination, a barrel, a magazine disposed above said barrel adapted to carry a plurality of grenades each embodying a primer and having a casing, pressure means in connection with said magazine adapted to urge said grenades into a loading position, a frame member having a track therein, a body underlying said frame member and having an ejection port at one side thereof, a grenade receiving pivot member mounted onto said track, a bolt member in coordination with said pivot member, means operatively connecting said bolt member and said pivot member moving said pivot member to become crosswise of said magazine, a casing ejecting means coordinated with said moving pivot member ejecting a fired grenade casing through said ejection port, a gate opening in said body feeding by said pressure means a grenade into a loading position as received by said pivot member as its movement ends, means moving forwardly into alignment with said barrel said bolt and said pivot member having said grenade, said bolt and said pivot member engaging the adjacent end of said barrel moving said grenade therein and forming a firing chamber, and said grenade being positioned to be fired.

* * * * *